US008481899B2

(12) United States Patent
Jun et al.

(10) Patent No.: US 8,481,899 B2
(45) Date of Patent: Jul. 9, 2013

(54) PTC ROD ASSEMBLY AND PREHEATER INCORPORATING THE SAME

(75) Inventors: Duck Chae Jun, Seongnam-si (KR); Tae Soo Sung, Asan-si (KR)

(73) Assignee: KB Autotech LLC, Chungcheongnam-Do (KR)

( * ) Notice: Subject to any disclaimer, the term of this patent is extended or adjusted under 35 U.S.C. 154(b) by 350 days.

(21) Appl. No.: 12/849,151

(22) Filed: Aug. 3, 2010

(65) Prior Publication Data

US 2011/0031228 A1 Feb. 10, 2011

(30) Foreign Application Priority Data

Aug. 4, 2009 (KR) ..... 10-2009-0071620

(51) Int. Cl.
*H05B 3/44* (2006.01)

(52) U.S. Cl.
USPC ..... 219/544; 219/202; 219/205; 219/546

(58) Field of Classification Search
USPC ..... 219/201, 202, 205, 208, 538, 539, 219/540, 541, 544, 546
See application file for complete search history.

(56) References Cited

U.S. PATENT DOCUMENTS

| | | | | |
|---|---|---|---|---|
| 4,814,584 | A * | 3/1989 | Bohlender et al. | 219/535 |
| 7,064,301 | B2 | 6/2006 | Han et al. | |
| 7,087,868 | B2 * | 8/2006 | Hamburger et al. | 219/541 |
| 2008/0173637 | A1 | 7/2008 | Taguchi | |

FOREIGN PATENT DOCUMENTS

| | | |
|---|---|---|
| JP | 2000168344 | 6/2000 |
| JP | 2007125967 | 5/2007 |
| KR | 1020080109959 | 12/2008 |

* cited by examiner

*Primary Examiner* — Matthew E Warren
(74) *Attorney, Agent, or Firm* — Michael Best & Friedrich LLP

(57) ABSTRACT

A Positive Temperature Coefficient (PTC) rod assembly and a preheater incorporating the same. The PTC rod assembly includes a negative terminal and a positive terminal coupled with opposite surfaces of a PTC rod, the negative and positive terminals being spaced apart from and parallel to each other; a PTC element interposed between and being in electrical contact with the negative and positive terminals, an insulating film adhered to exposed portions of the negative and positive terminals, which are coupled with the PTC rod, and a PTC rod housing. The PTC rod housing stores the PTC rod therein, the negative and positive terminals and the PTC element coupled with the PTC rod, and the insulating film adhered to the PTC rod. The PTC rod assembly is used stably even when a high voltage is applied thereto. A short circuit is prevented from occurring between the two terminals due to contact.

8 Claims, 6 Drawing Sheets

PTC ROD ASSEMBLY AND PREHEATER INCORPORATING THE SAME

CROSS REFERENCE TO RELATED APPLICATION

The present application claims priority to Korean Patent Application Number 10-2009-0071620 filed on Aug. 4,2009 the entire contents of which application is incorporated herein for all purposes by this reference.

BACKGROUND OF THE INVENTION

1. Field of the Invention

The present invention relates to a Positive Temperature Coefficient (PTC) rod assembly and a preheater incorporating the same, and more particularly, to a PTC rod assembly and a preheater incorporating the same, in which not only a positive terminal but also a negative terminal are provided so that the PTC rod assembly can be used stably even when a high voltage is applied thereto, and in which a short-circuit preventing means is provided to prevent a short circuit from occurring between the two terminals due to contact.

2. Description of Related Art

A typical vehicle has a heating apparatus that heats the interior of the vehicle or removes moisture or frost from the windshield of the vehicle using the thermal energy of coolant, which is heated by heat generated from the engine of the vehicle.

In the heating apparatus, since the coolant, which flows around the engine after the engine is started, is introduced into a heater, it takes a great deal of time to heat the coolant and to subsequently heat the interior of the vehicle. Accordingly, there is a problem in that a driver and/or passenger(s) may be required to stay in the cold interior of the vehicle for a certain period of time even after the engine has been started.

In order to solve this problem, preheaters are used. As a representative example, preheaters incorporating a Positive Temperature Coefficient (PTC) element therein are generally used.

The PTC element is a semiconductor element that exhibits a positive temperature characteristic, in which electrical resistance increases sharply at the Curie temperature or higher. The PTC element has a self-temperature control function, i.e.; it remains at a constant heating temperature irrespective of the surrounding temperature when a voltage is applied thereto. Since this characteristic of the PTC element is advantageous when utilized as a heating element, fields to which the PTC element is applicable as a heating element of a heater are expanding.

FIGS. 1 and 2 show a PTC rod assembly of the related art.

As shown in FIGS. 1 and 2, the PTC rod assembly 1 of the related art includes an elongated first PTC rod 100, which has a channel defined therein, and a second PTC rod 200, which is coupled with the first PTC rod 100 to close the opening of the channel of the first PTC rod 100. A positive terminal 400 is placed inside the first PTC rod 100 and is enclosed by an insulator such that it does not contact the first PTC rod 100. PTC elements 500 are interposed between and in contact with the positive terminal 400 and the second PTC rod 200. Heat transfer blocks 600, which are made of a material exhibiting high heat conductivity, are in contact and coupled with the positive terminal 400.

The PTC element 500 is configured to generate heat when electrical power is applied thereto, in which one side of the PTC element 500 is in contact with the positive terminal 400 and the other side of the PTC element 500 is in contact with the second PTC rod 200, which serves as a negative terminal. Here, since the first PTC rod 100 and the second PTC rod 200 are in contact with each other, not only the second PTC rod 200 but also the first PTC rod 100 serves as the negative terminal. In addition, the insulator of the positive terminal 400 has expanded portions 320 and 340 at opposite ends thereof. The expanded portions 320 and 340 are in close contact with the inner surfaces of the first and second PTC rods 100 and 200 when the first and second PTC rods 100 and 200 are coupled with each other. Therefore, the inner space defined by the first and second PTC rods 100 and 200 are closed by the expanded portions 320 and 340.

In this fashion, the first and second PTC rods 100 and 200, which enclose the PTC elements 500 and the positive terminal 400, serve as the negative terminal.

However, in the PTC rod assembly 1 of the related art as described above, the first and second PTC rods 100 and 200, serving as the negative terminal, are exposed to the outside and are thus vulnerable to a short circuit by contact with other components. The PTC rods 100 and 200 can be grounded in order to prevent this problem. However, they are still electrically instable when a high voltage is applied thereto.

The information disclosed in this Background of the Invention section is only for the enhancement of understanding of the background of the invention, and should not be taken as an acknowledgment or any form of suggestion that this information forms the prior art that would already be known to a person skilled in the art.

BRIEF SUMMARY OF THE INVENTION

Various aspects of the present invention provide a Positive Temperature Coefficient (PTC) rod assembly and a preheater incorporating the same, in which a separate negative terminal as well as a positive terminal is provided to prevent a short circuit from occurring, thereby ensuring stable operation.

In an aspect of the present invention, the PTC rod assembly includes a negative terminal and a positive terminal coupled with opposite surfaces of a PTC rod, the negative and positive terminals being spaced apart from and parallel to each other; a PTC element interposed between the negative and positive terminals, the PTC element being in electrical contact with the negative and positive terminals; an insulating film adhered to exposed portions of the negative and positive terminals, which are coupled with the PTC rod; and a PTC rod housing. The PTC rod housing stores the PTC rod therein, the negative and positive terminals and the PTC element coupled with the PTC rod, and the insulating film adhered to the PTC rod.

In an exemplary embodiment, a plurality of the PTC elements may be placed in a plurality of recesses, the recesses spaced from each other in the lengthwise direction of the PTC rod. The PTC rod may have coupling protrusions on opposite edges thereof, the negative terminal may have coupling recesses in opposite edges thereof, and the positive terminal may have coupling recesses in opposite edges thereof. The coupling protrusions of the PTC rod are fitted into and coupled with the coupling recesses of the negative and positive terminals In another exemplary embodiment, the portion of the negative terminal exposed from the PTC rod housing may be longer or shorter than that of the positive terminal.

In another aspect of the present invention, the preheater includes a plurality of the above-described PTC rod assemblies interposed between and coupled with first and second housings; heat dissipation fins attached to one or both surfaces of the PTC rod assembly such that the heat dissipation fins are able to transfer heat; and an insulating cap formed on the first housing. A longer one of the portions of the negative and positive terminals, which are exposed from the PTC rod housing, extends through the insulating cap.

In an exemplary embodiment, the insulating cap may have a height that is greater than the length of a shorter one of the portions of the negative and positive terminals, which are exposed from the PTC rod housing.

In another exemplary embodiment, the one of the negative and positive terminals, of which the portion exposed from the PTC rod housing is longer than that of the other one, may be connected to a terminal of a printed circuit board and is thereby electrically connected to a power supply terminal having a corresponding polarity, and the other one of the negative and positive terminals, of which the portion exposed from the PTC rod housing is shorter than that of the one terminal, may be connected to a ground plate of the first housing and be thereby electrically connected to a power supply terminal having a corresponding polarity.

According to the PTC rod assembly and the preheater according to exemplary embodiments of the invention, the negative terminal is provided inside the PTC rod in addition to the positive terminal and is configured to be insulated from the outside. This can prevent an apparatus from being damaged by a short circuit and ensure that the heater operates stably.

In addition, according to the PTC rod assembly and the preheater according to exemplary embodiments of the invention, the insulator is disposed on the exposed portions of the negative terminal and the positive terminal, such that the insulator prevents a short circuit from occurring as the two terminals come into contact with each other, thereby further improving electrical stability.

The methods and apparatuses of the present invention have other features and advantages which will be apparent from or are set forth in greater detail in the accompanying drawings, which are incorporated herein, and in the following Detailed Description of the Invention, which together serve to explain certain principles of the present invention.

DETAILED DESCRIPTION OF THE INVENTION

Figure 1:
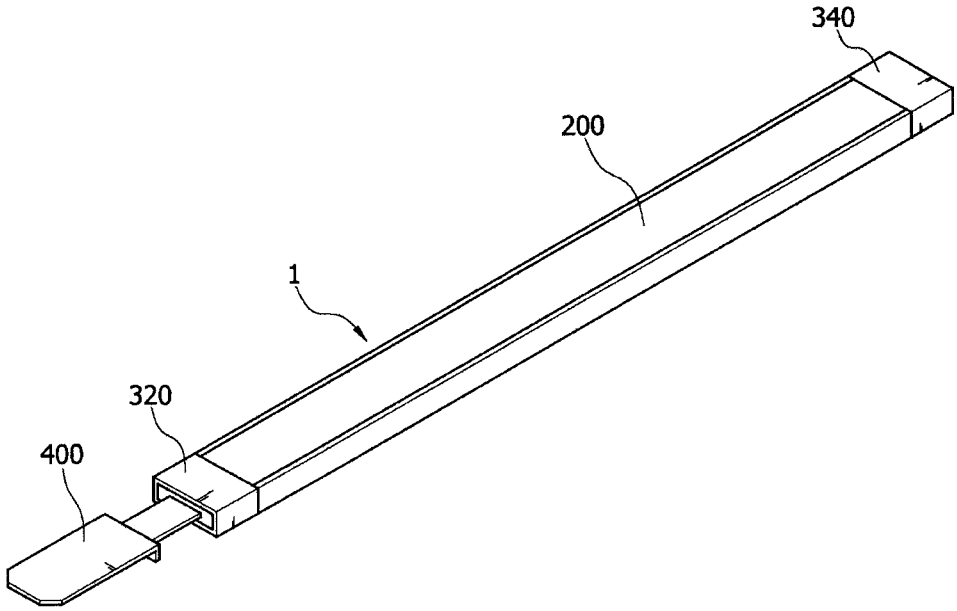
FIG. 1 is a perspective view showing a PTC rod assembly of the related art.
Figure 2:
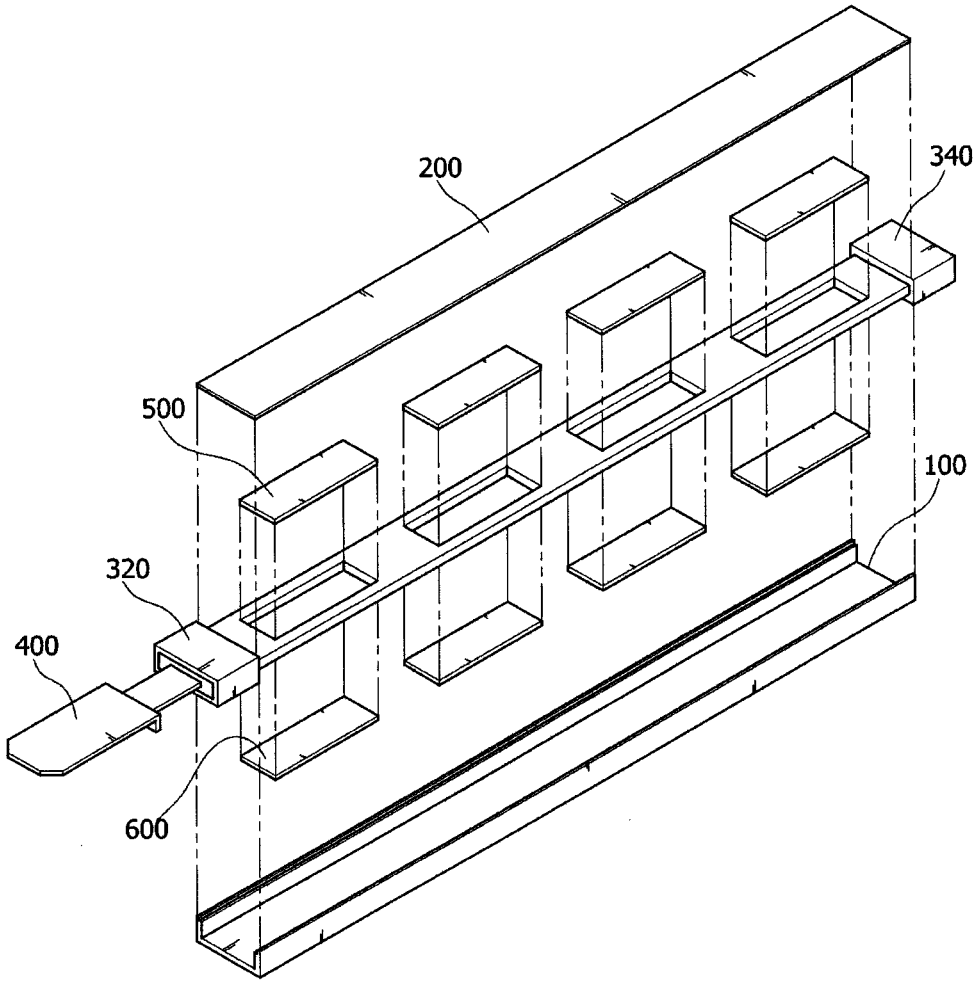
FIG. 2 is an exploded perspective view of the PTC rod assembly shown in FIG. 1.

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims. Above all, reference should be made to the drawings, in which the same reference numerals and signs are used throughout the different drawings to designate the same or similar components. In the following description of the present invention, a detailed description of known functions and components incorporated herein will be omitted when it may make the subject matter of the present invention rather unclear.

Figure 3:
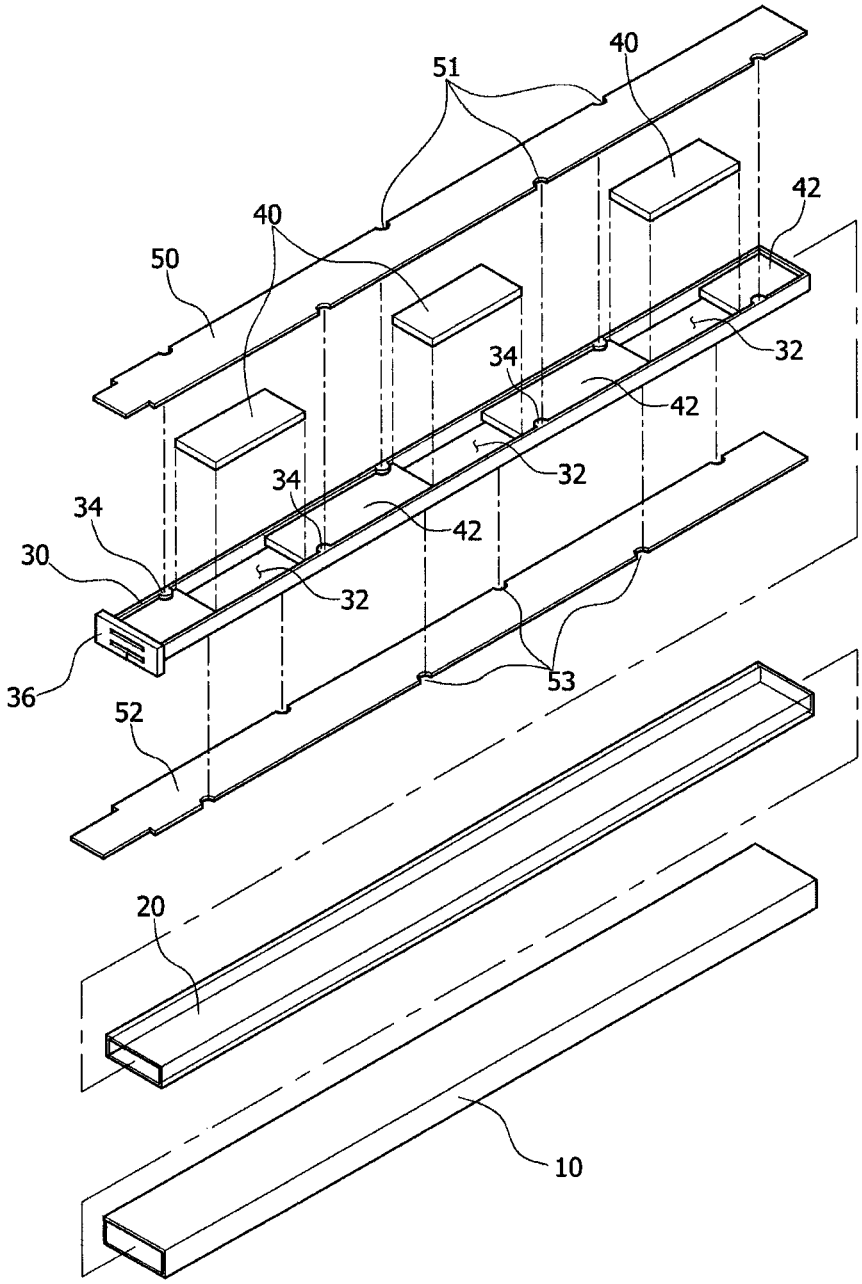
FIG. 3 is an exploded perspective view showing a PTC rod assembly according to an exemplary embodiment of the invention.
Figure 4:
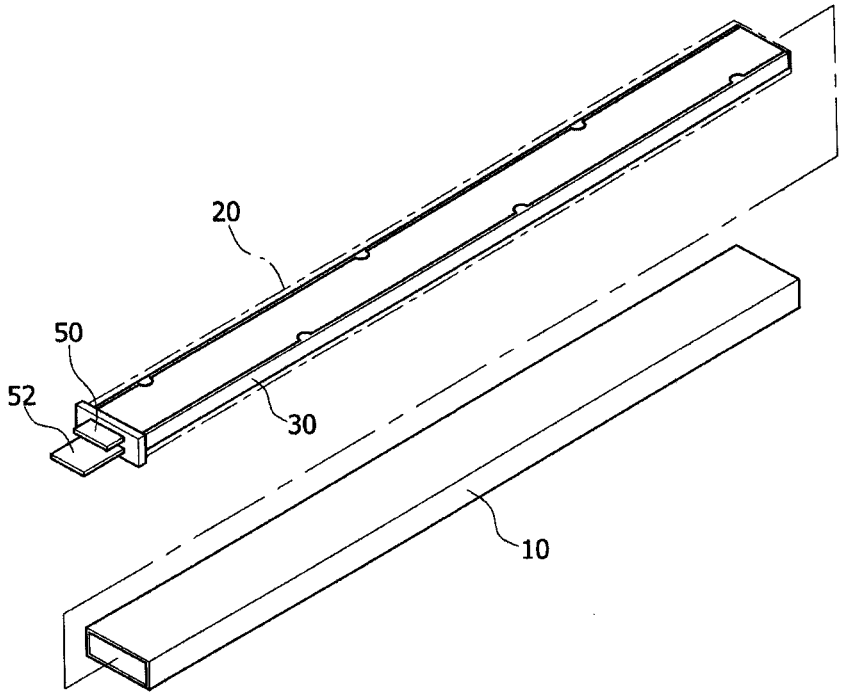
FIG. 4 is an assembled perspective view of the PTC rod assembly shown in FIG. 3.

FIG. 3 is an exploded perspective view showing a PTC rod assembly according to an exemplary embodiment of the invention, and FIG. 4 is an assembled perspective view of the PTC rod assembly shown in FIG. 3.

As shown in FIGS. 3 and 4, the PTC rod assembly of this embodiment of the invention includes an elongated PTC rod 30, which has a channel defined therein. The PTC rod assembly also includes a plurality of PTC elements 40, a plurality of spacer pieces 42, negative and positive terminals 50 and 52, a PTC rod housing 10, and an insulating film 20. The spacer pieces 42 are provided inside the PTC rod 30, and are spaced apart from each other at regular intervals in the lengthwise direction. The PTC elements 40 are arranged inside the PTC rod 30, such that each PTC element 40 alternates with an adjacent spacer piece 42 in the lengthwise direction. The negative terminal 50 is coupled with the upper surface of the PTC rod 30, and the positive terminal 52 is coupled with the underside surface of the PTC rod 30, such that the PTC elements 40 are interposed between the negative and positive terminals 50 and 52. The PTC rod housing 10 has defined therein a predetermined space in which the PTC rod 30 to which the negative and positive terminals 50 and 52 are coupled is stored. The insulating film 20 electrically isolates the negative and positive terminals 50 and 52 from the PTC rod housing 10. In addition, a contact preventing means for preventing the negative and positive terminals 50 and 52 from coming into contact with each other is provided on the portions of the terminals 50 and 52, which are exposed from the PTC rod housing 10.

In detail, the PTC rod housing 10 is configured as a tube that has defined therein a predetermined space, and the PTC rod 30, the PTC elements 40, the negative terminal 50, the positive terminal 52, and the insulating film 20 are stored in the space the PTC rod housing 10.

An assembly cap 36 is coupled with the leading end of the PTC rod 30. The assembly cap 36 has a cross-sectional area that is greater than that of the PTC rod 30. The assembly cap 36 has slots defined in the central portion thereof, such that the leading ends of the negative and positive terminals 50 and 52 can extend through the slots of the assembly cap 36 and be exposed from the PTC rod housing 10.

The assembly cap 36 encloses the leading end of the PTC rod housing 10 when the PTC rod 30, to which the negative and positive terminals 50 and 52 are coupled, is stored in the PTC rod housing 10, such that dust or other impurities are not introduced into the inside of the PTC rod housing 10, which could otherwise come into contact with the PTC elements 40, thereby causing a fire. In addition, the assembly cap 36 ensures that the negative and positive terminals 50 and 52 remain spaced apart from each other, thereby preventing the two terminals 50 and 52 from coming into contact from each other.

The spacer pieces 42 are formed integrally with the PTC rod 30 when the PTC rod 30 is formed by injection molding. The spacer pieces 42 are spaced apart from each other at regular intervals in the lengthwise direction of the PTC rod 30. The spacer pieces 42 serve to define the intervals between the PTC elements 40. With the spacer pieces 42 formed in the PTC rod 30, a plurality of recesses 32 is formed in the inner space of the PTC rod 30, in which the spacer pieces 42 are not formed. The recesses 32 are spaced apart from each other at regular intervals in the lengthwise direction of the PTC rod 30, and the PTC elements 40 are placed in respective recesses 32.

The negative and positive terminals 50 and 52 are provided in the space inside the PTC rod housing 10 and are electrically connected to the PTC elements 40, such that an electrical current can flow through the PTC elements 40. In order to supply the electric current to the PTC elements 40, the negative and positive terminals 50 and 52 can be made of a strong alloy steel, such as carbon steel.

The negative and positive terminals 50 and 52 are elongated in the same direction as the lengthwise direction of the PTC rod 30. The negative terminal 50 has coupling recesses 51 in opposite edges thereof, and the positive terminal 52 has coupling recesses 53 in opposite edges thereof. It is preferred that a plurality of the coupling recesses 51 be formed in the opposite edges of the negative terminal 50 and be spaced apart from each other in the lengthwise direction, and that a plurality of the coupling recesses 53 be formed in the opposite edges of the positive terminal 52 and be spaced apart from each other in the lengthwise direction.

Describing the coupling structure of the negative and positive terminals 50 and 52 and the PTC rod 30 in more detail, the coupling recesses 51 and 53 of the negative and positive terminals 50 and 52 and the coupling protrusions 34 of the PTC rod 30 are formed in corresponding positions. The coupling grooves 51 are formed along the opposite edges of the terminal 50 in a staggered arrangement, and the coupling grooves 53 are formed along the opposite edges of the terminal 52 in a staggered arrangement. In addition, the coupling protrusions 34 are formed along the opposite inner surfaces of the PTC rod 30 in a staggered arrangement. Due to the above-described configuration, when the negative and positive terminals 50 and 52 are coupled with the PTC rod 30, the coupling protrusions 34 of the PTC rod 30 are fixedly fitted into the coupling recesses 51 and 53. Accordingly, the negative and positive terminals 50 and 52 are fixedly coupled with the PTC rod 30 without playing in the transverse or lengthwise direction.

Unlike the above-described coupling structure of the terminals 50 and 52, it is possible to provide a coupling structure, which includes protrusions formed on the upper and underside surfaces of the spacer pieces 42 and through-holes formed in the negative and positive terminals 50 and 52, such that the protrusions are fitted into the through-holes. However, in the coupling structure having the through-holes in the terminals 50 and 52, since the through-holes serve as a resistance to an electrical current, they increase the loss of the electrical current and lower heat efficiency, thereby making the application of a resultant article difficult. Accordingly, the above-described coupling structure of this exemplary embodiment, in which the coupling protrusions 34 of the PTC rod 30 are fitted into the coupling recesses 51 and 53 on the edges of the terminals 50 and 52, is preferable.

The insulating film 20 is configured to prevent the inner surface of the PTC rod housing 10 from coming into electrical contact with the negative terminal 50 or the positive terminal 52. The insulating film 20 is made of a material, such as nylon, which exhibits good insulating property and high heat conductivity, and is provided in the form of a tape such that it can be attached to an intended place. When the negative terminal 50 and the positive terminal 52 are introduced into the PTC rod housing 10, a short circuit would take place if the terminal 50 or 52 comes into contact with the inner surface of the PTC rod housing 10. Thus, it is required to insulate the portions of the terminals 50 and 52, which are exposed to the outside. Therefore, when the terminals 50 and 52 are assembled to the PTC rod 30, the exposed portions of the terminals 50 and 52 are insulated using the insulating film 20, such that a short circuit can be prevented from occurring.

Although it is sufficient that the insulating film 20 insulates the exposed portions of the terminals 50 and 52 assembled to the PTC rod 30, the insulating film 20 can be provided in the form of a tube in order to facilitate assembly. Specifically, the insulating film 20 can be configured to surround the entire circumference of the PTC rod 30, to which both the negative and positive terminals 50 and 52 are coupled.

As described above, when the PTC elements 40, the positive terminal 52, the negative terminal 50, and the insulating film 20 are mounted inside the PTC rod housing 10, the PTC rod housing 10 is pressed from outside so that the above-mentioned components are brought into close contact with each other. In this fashion, the PTC rod assembly according to an exemplary embodiment of the invention is manufactured. In the PTC rod assembly manufactured as above, one side of each PTC element 40 is brought into contact with and is electrically connected with the positive terminal 52, and the other side of each PTC element 40 is brought into contact with and is electrically connected with the negative terminal 50. When a voltage is applied to the negative terminal 50 and the positive terminal 52, the PTC elements 40 generate heat, which is then transferred to the outside.

Figure 6:
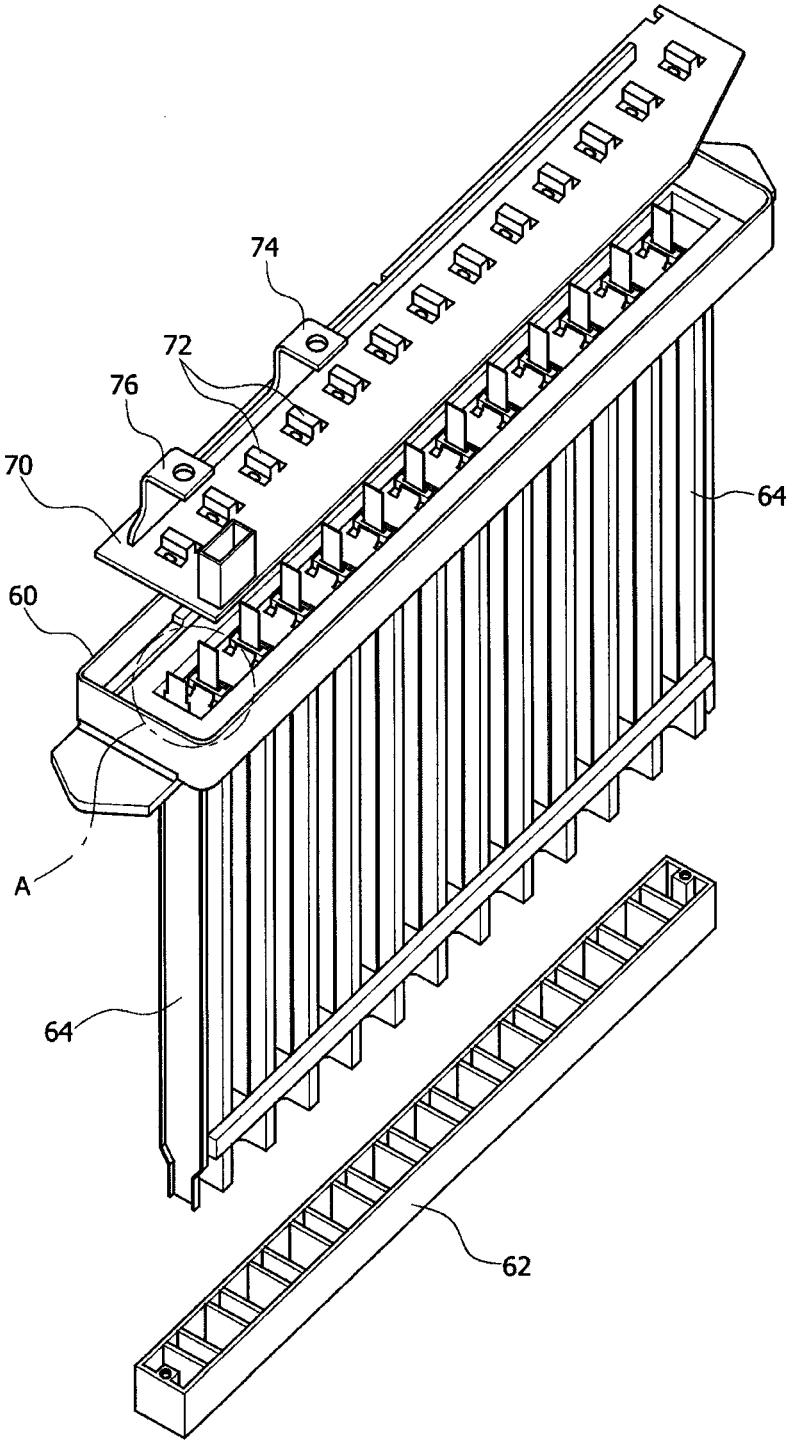
FIG. 6 is an exploded perspective view showing a preheater for a vehicle on which a plurality of PTC rod assemblies according to an exemplary embodiment of the invention is mounted.
Figure 7:
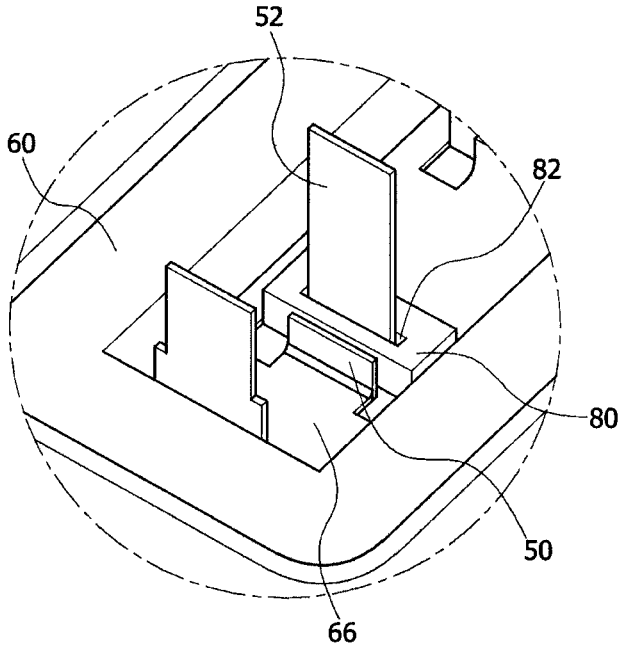
FIG. 7 is a magnified view of part A of FIG. 6.
Figure 8:
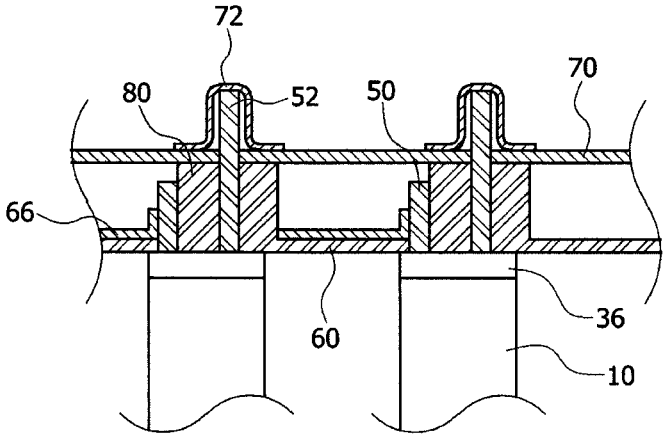
FIG. 8 is an assembled cross-sectional view showing a preheater for a vehicle on which a plurality of PTC rod assemblies according to an exemplary embodiment of the invention is mounted.

In addition, FIGS. 6 to 8 show a preheater for a vehicle on which a plurality of PTC rod assemblies according to an exemplary embodiment of the invention is mounted. The PTC rod assemblies having the above-described configuration are arranged in parallel and assembled between first and second housings 60 and 62 by a pair of fixing frames 64, which is coupled with the outer surfaces of the outermost PTC rod assemblies. In this state, the PTC rod assemblies are connected to a power source. Here, each positive terminal 52 is electrically connected with a positive power supply terminal 76 by contact with each electrode 72, which is formed on a Printed Circuit Board (PCB) 70. In addition, each negative terminal 50 is electrically with a negative power supply terminal 76 by contact with a ground plate 66, which is formed on the upper surface of the first housing 60. Accordingly, respective positive terminals 52 of the PTC rod assemblies are electrically connected with the positive terminal of a power supply through the terminals 72 of the PCB 70, and respective negative terminals 50 of the PTC rod assemblies are electrically connected with the negative terminal of the power supply through the ground plate 66 of the first housing 60.

In this embodiment, since the portion of the positive terminal 52, which is exposed from the PTC rod housing 10, is longer than that of the negative terminal 50, the positive terminal 52 is connected to the terminal 72 of the PCT 70, and the negative terminal 50 is connected to the ground plate 66. If the portion of the negative terminal 50, which is exposed from the PTC rod housing 10, is longer than that of the positive terminal 52, the negative terminal 50 is fitted into an insulating cap 80, which will be described later, and is thus connected to the terminal of the PCB 70, and the positive terminal 52 is connected to the ground plate 66.

If the portions of the negative and positive terminals 50 and 52, which are exposed from the rod housing 10, have the same length, the negative terminal 50 can come into contact with the terminal 72 of the PCB 70. Thus, it is preferred that the height of the negative terminal 50 be not greater than that required for the exposed portion thereof to come into contact with the ground plate 66 when the negative terminal 50 is coupled with the first housing 60.

Since the negative and positive terminals 50 and 52 installed inside the PTC rod housing 10 are isolated from each other with the PTC rod 30 interposed therebetween, they are not electrically connected with each other. However, since the portions of the negative and positive terminals 50 and 52, which are exposed from the leading end of the PTC rod housing 10, are adjacent to each other when the negative and positive terminals 50 and 52 are assembled to the first housing 60, they may come into contact with each other if any of them is bent due to an external impact or pressure. When the negative and positive terminals 50 and 52 are in contact with each other, a short circuit occurs and thus the heater cannot operate stably.

In order to prevent the short circuit, it is required to prevent an electrical connection even when the two terminals 50 and 52 are in contact with each other, or to fundamentally prevent the two terminals 50 and 52 from coming into contact with each other.

Figure 5:
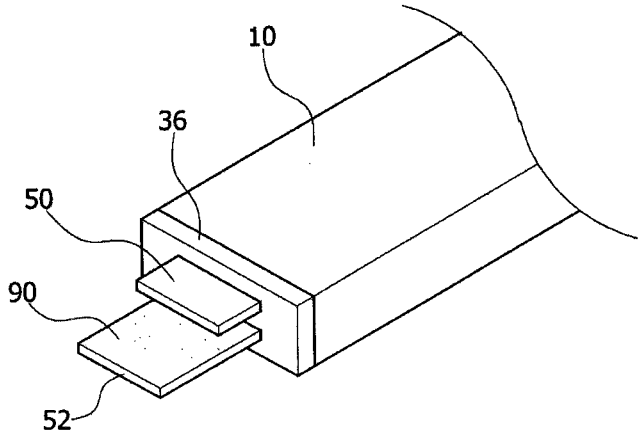
FIG. 5 is a perspective view showing an exemplary embodiment of an insulator of the PTC rod assembly of the invention.

As a measure for this purpose, as shown in FIG. 5, the insulating film 90 is attached to one of the opposite surfaces of the exposed portions of the negative and positive terminals 50 and 52. With this configuration, it is possible to prevent a short circuit from occurring even when the terminals 50 and 52 are in contact with each other, since the insulating film 90 prevents an electrical current from flowing between the negative and positive terminals 50 and 52.

Alternatively, as shown in FIGS. 6 to 8, it is possible to fundamentally prevent the negative and positive terminals 50 and 52 from coming into contact with each other by interposing an insulator between the exposed portions of the terminals 50 and 52. Here, the insulator interposed between the terminals 50 and 52 is formed as the insulating cap 80, through which one of the terminals 50 and 52 penetrates. The insulating cap 80 is manufactured integrally with the first housing 60 by injection molding. Since one terminal 50 or 52 is fitted into a terminal slot 82, which penetrates the central portion of the insulating cap 80, the terminals 50 and 52 are prevented from coming into contact with each other. In particular, as shown in FIG. 8, it is preferred that the terminal 52, the exposed portion of which is longer than that of the terminal 50, be fitted into the insulating cap 80, since it is required that the terminal 50 be electrically connected with the ground plate 66 of the first housing 60 and the terminal 52 be electrically connected with the terminal 72 of the PCB 70. In this exemplary embodiment, the positive terminal 52 is fitted into the insulating cap 80 since the exposed portion of the positive terminal 52 is formed longer than the exposed portion of the negative terminal 50. Here, the positive terminal 52 can come into contact with the terminal 72 of the PCB 70 only if the height of the insulating cap 80 is smaller than the length of the exposed portion of the positive terminal 52.

Furthermore, it is preferred that the height of the insulating cap 80 be greater than the length of the exposed portion of the negative terminal 50. When the insulating cap 80 is coupled with the positive terminal 52, the negative terminal 50 is in contact with the outer surface of the side wall of the insulating cap 80. This is to prevent the portion of the negative terminal 50, which is in contact with the edge of the insulating cap 80, from being bent by an external force, so that the negative terminal 50 does not come into contact with the positive terminal 52. That is, the exposed portion of the positive terminal 52 extends beyond the height of the insulating cap 80, protruding above the insulating cap 80. In contrast, the exposed portion of the negative terminal 50 does not extend beyond the height of the insulating cap 80, such that it does not protrude above the insulating cap 80. Thus, even when an external force is applied to the negative terminal 50, the terminals 50 and 52 are not brought into contact with each other. Accordingly, this configuration ensures that a short circuit does not occur due to contact between the negative and positive terminals.

The foregoing descriptions of specific exemplary embodiments of the present invention have been presented for the purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the claims appended hereto and their equivalents.

What is claimed is:

1. A positive temperature coefficient rod assembly comprising:

a positive temperature coefficient rod;

a negative terminal and a positive terminal coupled with opposite surfaces of the positive temperature coefficient rod, the negative and positive terminals being spaced apart from and parallel to each other;

a positive temperature coefficient element interposed between the negative and positive terminals, the positive temperature coefficient element being in electrical contact with the negative and positive terminals;

an insulating film adhered to exposed portions of the negative and positive terminals, which are coupled with the positive temperature coefficient rod; and a positive temperature coefficient rod housing, wherein the positive temperature coefficient rod housing stores the positive temperature coefficient rod therein, the negative and positive terminals and the positive temperature coefficient element coupled with the positive temperature coefficient rod, and the insulating film adhered to the positive temperature coefficient rod, wherein the portion of the negative terminal exposed from the positive temperature coefficient rod housing is longer or shorter than that of the positive terminal.

2. The positive temperature coefficient rod assembly according to claim 1, wherein a plurality of the positive temperature coefficient elements is placed in a plurality of recesses, the recesses spaced from each other in a lengthwise direction of the positive temperature coefficient rod.

3. The positive temperature coefficient rod assembly according to claim 2, wherein the positive temperature coefficient rod has coupling protrusions on opposite edges thereof, the negative terminal has coupling recesses in opposite edges thereof, and the positive terminal has coupling recesses in opposite edges thereof, wherein the coupling protrusions of the positive temperature coefficient rod are fitted into and coupled with the coupling recesses of the negative and positive terminals.

4. A preheater comprising:

a plurality of positive temperature coefficient rod assemblies interposed between and coupled with first and second housings, wherein each of the assemblies comprises:

a positive temperature coefficient rod;

a negative terminal and a positive terminal coupled with opposite surfaces of the positive temperature coefficient rod, the negative and positive terminals being spaced apart from and parallel to each other;

a positive temperature coefficient element interposed between the negative and positive terminals, the positive temperature coefficient element being in electrical contact with the negative and positive terminals;

an insulating film adhered to exposed portions of the negative and positive terminals, which are coupled with the positive temperature coefficient rod; and a positive temperature coefficient rod housing, wherein the positive temperature coefficient rod housing stores the positive temperature coefficient rod therein, the negative and positive terminals and the positive temperature coefficient element coupled with the positive temperature coefficient rod, and the insulating film adhered to the positive temperature coefficient rod;

heat dissipation fins attached to one or both surfaces of the positive temperature coefficient rod assembly such that the heat dissipation fins are able to transfer heat; and an insulating cap formed on the first housing, wherein a longer one of the portions of the negative and positive terminals, which are exposed from the positive temperature coefficient rod housing, extends through the insulating cap.

5. The preheater according to claim 4, wherein a plurality of the positive temperature coefficient elements is placed in a plurality of recesses, the recesses spaced from each other in a lengthwise direction of the positive temperature coefficient rod.

6. The preheater according to claim 4, wherein the positive temperature coefficient rod has coupling protrusions on opposite edges thereof, the negative terminal has coupling recesses in opposite edges thereof, and the positive terminal has coupling recesses in opposite edges thereof, wherein the coupling protrusions of the positive temperature coefficient rod are fitted into and coupled with the coupling recesses of the negative and positive terminals.

7. The preheater according to claim 4, wherein the insulating cap has a height that is greater than a length of a shorter one of the portions of the negative and positive terminals, which are exposed from the positive temperature coefficient rod housing.

8. The preheater according to claim 7, wherein the one of the negative and positive terminals, of which the portion exposed from the positive temperature coefficient rod housing is longer than that of the other one, is connected to a terminal of a printed circuit board and is thereby electrically connected to a power supply terminal having a corresponding polarity, and wherein the other one of the negative and positive terminals, of which the portion exposed from the positive temperature coefficient rod housing is shorter than that of the one terminal, is connected to a ground plate of the first housing and is thereby electrically connected to a power supply terminal having a corresponding polarity.

* * * * *